US012760946B2

(12) United States Patent
Lin et al.

(10) Patent No.: US 12,760,946 B2
(45) Date of Patent: Oct. 13, 2026

(54) BIDIRECTIONAL THROTTLE VALVE, FIRST AIR CONDITIONING SYSTEM AND SECOND AIR CONDITIONING SYSTEM

(71) Applicant: ZHEJIANG DUNAN ARTIFICIAL ENVIRONMENT CO., LTD., Shaoxing (CN)

(72) Inventors: Yuanyang Lin, Shaoxing (CN); Lihua Xuan, Shaoxing (CN); Jing Feng, Shaoxing (CN)

(73) Assignee: ZHEJIANG DUNAN ARTIFICIAL ENVIRONMENT CO., LTD., Shaoxing (CN)

( * ) Notice: Subject to any disclaimer, the term of this patent is extended or adjusted under 35 U.S.C. 154(b) by 172 days.

(21) Appl. No.: 18/645,511

(22) Filed: Apr. 25, 2024

(65) Prior Publication Data

US 2024/0288205 A1 Aug. 29, 2024

Related U.S. Application Data

(63) Continuation of application No. PCT/CN2022/125871, filed on Oct. 18, 2022.

(30) Foreign Application Priority Data

Nov. 5, 2021 (CN) ..... 202111307151.8
Nov. 5, 2021 (CN) ..... 202122707906.5

(51) Int. Cl.
*F25B 41/325* (2021.01)
*F25B 13/00* (2006.01)

(52) U.S. Cl.
CPC ..... *F25B 41/325* (2021.01); *F25B 13/00* (2013.01); *F25B 2313/02741* (2013.01)

(58) Field of Classification Search
CPC .... F25B 41/385; F25B 47/025; F25B 41/325; F25B 13/00
See application file for complete search history.

(56) References Cited

FOREIGN PATENT DOCUMENTS

CN 101571334 A 11/2009
CN 209181325 U 7/2019
(Continued)

OTHER PUBLICATIONS

Song et al. (CN111750575A), English Translation, Two-way throttle valve, Oct. 9, 2020, Whole Document (Year: 2020).*
(Continued)

*Primary Examiner* — Jerry-Daryl Fletcher
*Assistant Examiner* — Keith Stanley Myers

(57) ABSTRACT

A bidirectional throttle valve and an air conditioning system provided with same are provided. The bidirectional throttle valve includes a valve pipe, an inner wall of the first valve core cooperates with an inner wall of the first valve opening to form a first circulation channel. An inner wall of the second valve core cooperates with an inner wall of the second valve opening to form a second circulation channel. When the first valve opening and the second valve opening are in an opened state, a flow area of the first circulation channel is greater than a flow area of the second circulation channel. And the second valve core cooperates with the second valve opening to achieve throttling. The present disclosure further provides an air conditioning system, which includes the above bidirectional throttle valve.

20 Claims, 10 Drawing Sheets

(56) References Cited

FOREIGN PATENT DOCUMENTS

| | | | |
|---|---|---|---|
| CN | 209944791 | U | 1/2020 |
| CN | 111750575 | A | 10/2020 |
| CN | 111998577 | A | 11/2020 |
| CN | 216644630 | U | 5/2022 |
| JP | H07120115 | A | 5/1995 |
| JP | 2007232224 | A | 9/2007 |

OTHER PUBLICATIONS

Cheng (CN209944791U), English Translation, Air conditioning system, Jan. 14, 2020, Whole Document (Year: 2020).*
Notice of rejection decision of JP2024-519457.
International Search Report of PCT/CN2022/125871.
First Notice of Reasons for Refusal of KR10-2024-7014203.

* cited by examiner

BIDIRECTIONAL THROTTLE VALVE, FIRST AIR CONDITIONING SYSTEM AND SECOND AIR CONDITIONING SYSTEM

CROSS-REFERENCE TO RELATED APPLICATIONS

This application is a continuation of international patent application No. PCT/CN2022/125871, filed on Oct. 18, 2022, which itself claims priority to Chinese patent application Nos. 202111307151.8, filed on Nov. 5, 2021, and titled "BIDIRECTIONAL THROTTLE VALVE, FIRST AIR CONDITIONING SYSTEM AND SECOND AIR CONDITIONING SYSTEM", and 202122707906.5, filed on Nov. 5, 2021, and titled "BIDIRECTIONAL THROTTLE VALVE, FIRST AIR CONDITIONING SYSTEM AND SECOND AIR CONDITIONING SYSTEM". The contents of the above identified applications are hereby incorporated herein in their entireties by reference.

TECHNICAL FIELD

The present disclosure relates to the field of valve technology, and in particular, to a bidirectional throttle valve, a first air conditioning system and a second air conditioning system.

BACKGROUND

A throttle valve is mainly used in air conditioning refrigeration system, which is an important part of a refrigeration system. A bidirectional throttle valve is commonly employed in an air conditioning system of cold and warm type, by providing two throttle valve components arranged either in parallel or in series to achieve bidirectional circulation function.

In the related art, both a unidirectional throttle valve and the bidirectional throttle valve have limitations. While the unidirectional throttle valve can enable one-way circulation, the bidirectional throttle valve facilitates two-way circulation. However, a flow rate of the bidirectional throttle valve is often limited, which may not satisfy the simultaneous requirements of two-way circulation and one-way throttling for certain models. Additionally, it may not meet the demands for low pressure and high flow rate on a defrosting side under defrosting conditions.

SUMMARY

According to various embodiments of the present disclosure, a bidirectional throttle valve is provided.

The present disclosure provides a bidirectional throttle valve. The bidirectional throttle valve includes a valve pipe, a first valve core assembly and a second valve core assembly are arranged at two ends in the valve pipe, respectively. The first valve core assembly includes a first valve core, a first valve opening is arranged in the first valve core assembly, the first valve core is movably arranged in the valve pipe and capable of opening or closing the first valve opening, and the first valve core cooperates with an inner wall of the first valve opening to form a first circulation channel. The second valve core assembly includes a second valve core, a second valve opening is arranged in the second valve core assembly, the second valve core is movably arranged in the valve pipe and capable of opening or closing the second valve opening, and the second valve core cooperates with an inner wall of the second valve opening to form a second circulation channel. When the first valve opening and the second valve opening are in an opened state, a flow area of the first circulation channel is greater than a flow area of the second circulation channel, and the second valve core cooperates with the second valve opening to achieve throttling.

In some embodiments, the valve pipe is connected to air conditioning system pipeline, a communicating member is further arranged in the valve pipe, and the first valve core assembly is installed at an end of the communicating member. The communicating member is provided with a first channel, which is connected with and in communication with the first valve opening. A size of the first valve opening is defined as D1, a size of the first channel is defined as D2, and a size of the air conditioning system pipeline is defined as D3, and the size D1 of the first valve opening, the size D2 of the first channel and the size D3 of the air conditioning system pipeline satisfy the following formula: $D2 \geq D1 \geq D3$.

In some embodiments, the valve pipe is connected to air conditioning system pipeline, a communicating member is further arranged in the valve pipe, and the first valve core assembly is installed at an end of the communicating member. A size of the first valve opening is defined as D1, and a size of the air conditioning system pipeline is defined as D3, the size D1 of the first valve opening and the size D3 of the air conditioning system pipeline satisfy the following formula: $D1 < D3$.

In some embodiments, a size of the second valve opening is defined as D4, the size D1 of the first valve opening and the size D4 of the second valve opening satisfy the following formula:

$$D4 > D1 > (1/3)D4.$$

In some embodiments, the first valve core assembly includes a first valve seat, the first valve core is movably arranged in the first valve seat, and the first valve opening is disposed on the first valve seat. A flow area of a gap between a sidewall of the first valve core and an inner wall of the first valve seat is greater than a flow area of the first valve opening.

In some embodiments, the second valve core assembly includes a second valve seat, the second valve core is movably arranged in the second valve seat, and the second valve opening is disposed on the second valve seat. A flow area of a gap between a sidewall of the second valve core and an inner wall of the second valve seat is smaller than a flow area of the second valve opening.

In some embodiments, the first valve core assembly includes a first valve seat, the first valve core is movably arranged in the first valve seat. An end of the first valve seat away from the second valve core assembly is provided with a first sealing head.

In some embodiments, the second valve core assembly includes a second valve seat, and the second valve core is movably arranged in the second valve seat. A second sealing head and an elastic member are arranged in the second valve seat, the second sealing head is arranged at an end of the second valve seat away from the first valve core assembly, and two ends of the elastic member abut against the second valve core and the second sealing head, respectively.

In some embodiments, the first channel is a linear channel inclined relative to an axial direction of the communicating member.

The present disclosure further provides a first air conditioning system. The first air conditioning system includes a compressor, a first heat exchanger, a second heat exchanger, a four-way valve and at least two of the above bidirectional throttle valves. The bidirectional throttle valves include a first bidirectional throttle valve and a second bidirectional throttle valve, the first heat exchanger is connected between a first port (A) of the four-way valve and one end of the first bidirectional throttle valve adjacent to the second valve core assembly. The second heat exchanger is connected between a second port (B) of the four-way valve and one end of the second bidirectional throttle valve adjacent to the second valve core assembly, the other end of the first bidirectional throttle valve adjacent to the first valve core assembly is connected to other end of the second bidirectional throttle valve adjacent to the first valve core assembly. And the compressor is connected between a third port (C) of the four-way valve and a fourth port (D) of the four-way valve.

In some embodiments, the number of the second heat exchanger is at least two, and the number of the second bidirectional throttle valve is at least two. Each of the at least two second heat exchangers is connected between the second port (B) of the four-way valve and one end of each of the at least two second bidirectional throttle valves adjacent to the second valve core assembly, the other end of each of the at least two second bidirectional throttle valves adjacent to the first valve core assembly are connected with each other.

The present disclosure further provides a second air conditioning system. The second air conditioning system includes a compressor, a first heat exchanger, a second heat exchanger, a four-way valve and at least two of the above bidirectional throttle valves. The heat exchanger is connected between a first port (A) of the four-way valve and one end of the first bidirectional throttle valve adjacent to the first valve core assembly. The second heat exchanger is connected between a second port (B) of the four-way valve and one end of the bidirectional throttle valve adjacent to the second valve core assembly. And the compressor is connected between a third port (C) of the four-way valve and a fourth port (D) of the four-way valve.

Details of one or more embodiments of this application are presented in the attached drawings and descriptions below. And other features, purposes and advantages of this application will become apparent from the description, drawings and claims.

BRIEF DESCRIPTION OF THE DRAWINGS

For a better description and illustration of embodiments and/or examples of those disclosures disclosed herein, reference may be made to one or more attached drawings. Additional details or examples used to describe the drawings should not be considered as limiting the scope of any of the disclosed disclosures, currently described embodiments and/or examples, and currently understood best modes of these disclosures.

Figure 1:
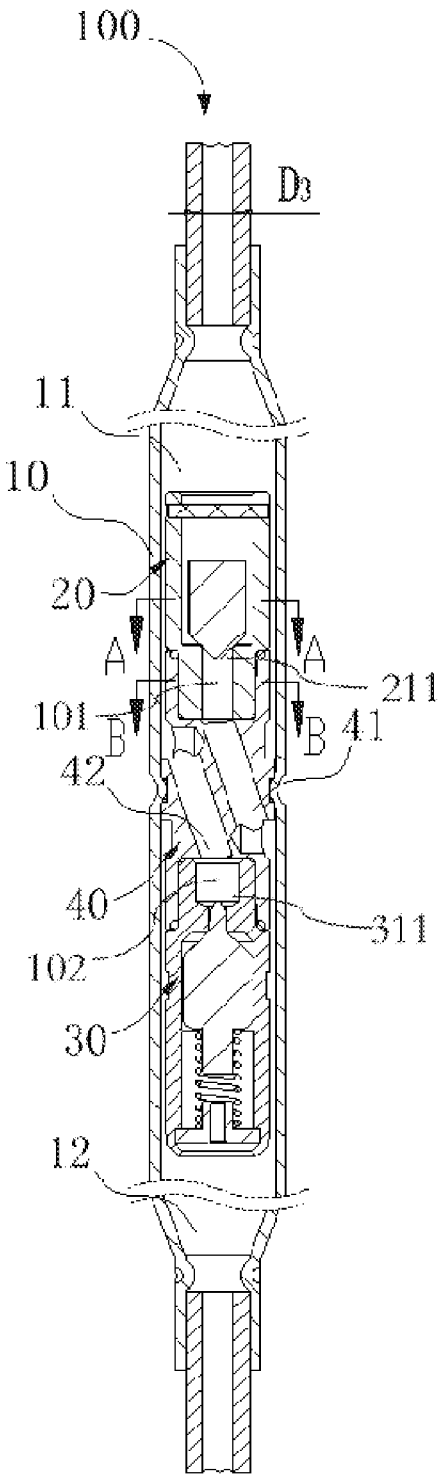
FIG. 1 is a schematic view of a bidirectional throttle valve according to the present disclosure.

Reference signs are as follows:

100 represents a bidirectional throttle valve; 101 represents a first circulation channel; 102 represents a second circulation channel; 10 represents a valve pipe; 11 represents a first valve cavity; 12 represents a second valve cavity; 20 represents a first valve core assembly; 21 represents a first valve seat; 211 represents a first valve opening; 212 represents a first seat cavity; 22 represents a first valve core; 23 represents a first sealing head; 30 represents a second valve core assembly; 31 represents a second valve seat; 311 represents a second valve opening; 312 represents a second seat cavity; 32 represents a second valve core; 33 represents a second sealing head; 34 represents an elastic member; 40 represents a communicating member; 41 represents a first channel; 42 represents a second channel; 43 represents a first cavity; 44 represents a second cavity; 200 represents an air conditioning system; 201 represents a first air conditioning system; 202 represents a second air conditioning system; 50 represents a compressor; 60 represents a first heat exchanger; 61 represents a second heat exchanger; 70 represents a four-way valve; 80 represents a first bidirectional throttle valve; 81 represents a second bidirectional throttle valve; and 90 represents an air conditioning system pipeline.

DETAILED DESCRIPTION

The technical scheme in the embodiment of this application will be described clearly and completely with the attached drawings. Obviously, the described embodiment is only a part of the embodiment of this application, not the whole embodiment. Based on the embodiments in this application, all other embodiments obtained by ordinary technicians in this field without creative work belong to the protection scope of this application.

It should be noted that when a component is considered to be "mounted" on another component, it can be directly on the other component or there can be a component in the middle. When a component is considered to be "set on" another component, it can be directly set on another component or there may be intervening components at the same time. When a component is considered to be "fixed" to another component, it can be directly fixed to another component or there may be intervening components at the same time. The terms "vertical", "horizontal", "left" and "right" and similar expressions used herein are only for the purpose of illustration and do not represent the only embodiment.

Unless otherwise defined, all technical and scientific terms used herein have the same meaning as commonly understood by those skilled in the technical field of this application. The terminology used herein in the specification of this application is only for the purpose of describing specific embodiments, and is not intended to limit this application. As used herein, the term "or/and" includes any and all combinations of one or more related listed items.

Referring to FIG. 1 to FIG. 12, in an embodiment, the present disclosure provides a bidirectional throttle valve 100, which is employed in an air conditioning system 200. The bidirectional throttle valve 100 is mainly used in an air conditioning system of cold and warm type, by providing with two throttle valve components arranged in parallel or series to achieve bidirectional circulation function.

In the related art, both a unidirectional throttle valve and the bidirectional throttle valve have limitations. While the unidirectional throttle valve can enables one-way circulation, the bidirectional throttle valve facilitates two-way circulation. However, a flow rate of the bidirectional throttle valve is often limited, which may not satisfy the simultaneous requirements of two-way circulation and one-way throttling for certain models. Additionally, it may not meet the demands for low pressure and high flow rate on a defrosting side under defrosting conditions.

In order to solve problems of the bidirectional throttle valve in the related art, an embodiment of the present disclosure provides a bidirectional throttle valve 100. The bidirectional throttle valve 100 includes a valve pipe 10. A first valve core assembly 20 and a second valve core assembly 30 are arranged at two ends in the valve pipe 10, respectively. The first valve core assembly 20 includes a first valve core 22. A first valve opening 211 is arranged in the first valve core assembly 20. The first valve core 22 is movably arranged in the valve pipe 10 and capable of opening or closing the first valve opening 211. The first valve core 22 cooperates with an inner wall of the first valve opening 211 to form a first circulation channel 101. The second valve core assembly 30 includes a second valve core 32. A second valve opening 311 is arranged in the second valve core assembly 30. The second valve core 32 is movably arranged in the valve pipe 10 and capable of opening or closing the second valve opening 311. The second valve core 32 cooperates with an inner wall of the second valve opening 311 to form a second circulation channel. When the first valve opening 211 and the second valve opening 311 are in an opened state, a flow area of the first circulation channel is greater than a flow area of the second circulation channel 102. The second valve core 32 cooperates with the second valve opening 311 to achieve throttling.

When the first valve opening 211 and the second valve opening 311 are both in an opened state, the present disclosure enhances circulation by enlarging the flow area of the first circulation channel compared to the flow area of the second circulation channel. This approach not only enables the bidirectional throttle valve 100 to achieve both bidirectional circulation and unidirectional throttling functions, but also meets requirements of low pressure and high flow rates under the defrosting condition.

Referring to FIG. 1 to FIG. 4, a communicating member 40 is further arranged in the valve pipe 10. The communicating member 40 is arranged in the valve pipe 10 and divides the valve pipe 10 into a first valve cavity 11 and a second valve cavity 12. The communicating member 40 is provided with a first cavity 43, a second cavity 44, a first channel 41 and a second channel 42. The first cavity 43 is located at one end of the communicating member 40 adjacent to the first valve cavity 11. The second cavity 44 is located at other end of the communicating member 40 adjacent to the second valve cavity 12. The first channel 41 is in communication with the first cavity 43 and the second valve cavity 12. The second channel 42 is in communication with the second cavity 44 and the first valve cavity 11. The first valve core assembly 20 is installed in the first cavity 43 to automatically adjust a flow between the first channel 41 and the first valve cavity 11. The second valve core assembly 30 is installed at the second cavity 44 to adjust a flow between the second channel 42 and the second valve cavity 12.

Figure 2:
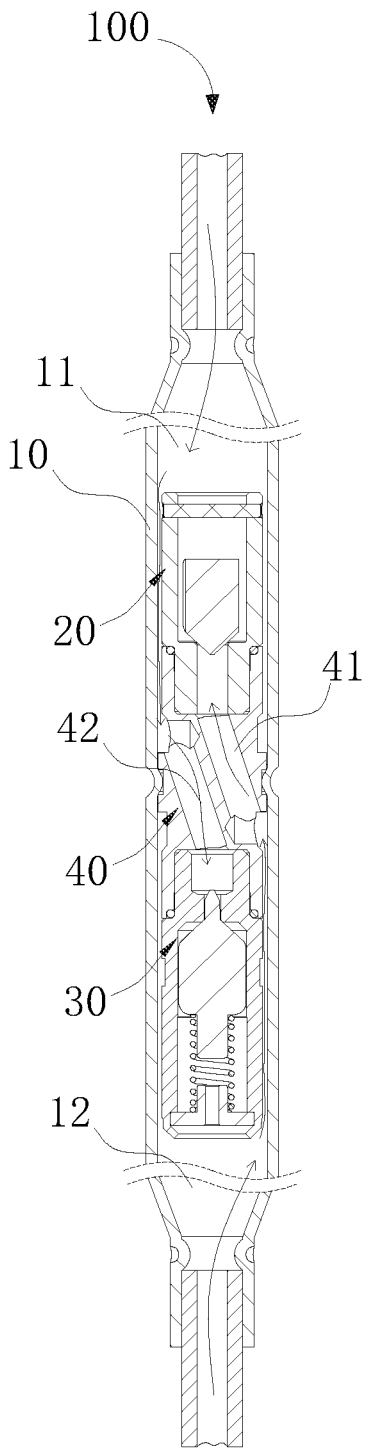
FIG. 2 is a schematic view of two way flow directions of a bidirectional throttle valve according to the present disclosure.

Referring to FIG. 2, when the bidirectional throttle valve 100 is in operation, a fluid can enter the second channel 42, the second cavity 44, the second valve core assembly 30 and finally the second valve cavity 12 from the first valve cavity 11. The fluid can also enter the first channel 41, the first cavity 43, the first valve core assembly 20 and finally the first valve cavity 11 from the second valve cavity 12. In this way, the bidirectional throttle valve 100 can achieve bidirectional circulation through the valve pipe 10, the communicating member 40, the first valve core assembly 20 and the second valve core assembly 30, with fewer parts and a very simple structure. Specifically, when installing, only the communicating member 40 needs to be installed in the valve pipe 10. And the first valve core assembly 20 and the second valve core assembly 30 are install at two ends of the communicating member 40, respectively, and an assembly work of the bidirectional throttle valve 100 can be completed, and an installation process is very simple, which reduces a probability of defective products in the assembly process and is conducive to an improvement of product consistency, thus greatly reducing a production cost of the bidirectional throttle valve 100. "Product consistency" refers to a fact that different products are basically the same in mass production.

Figure 3:
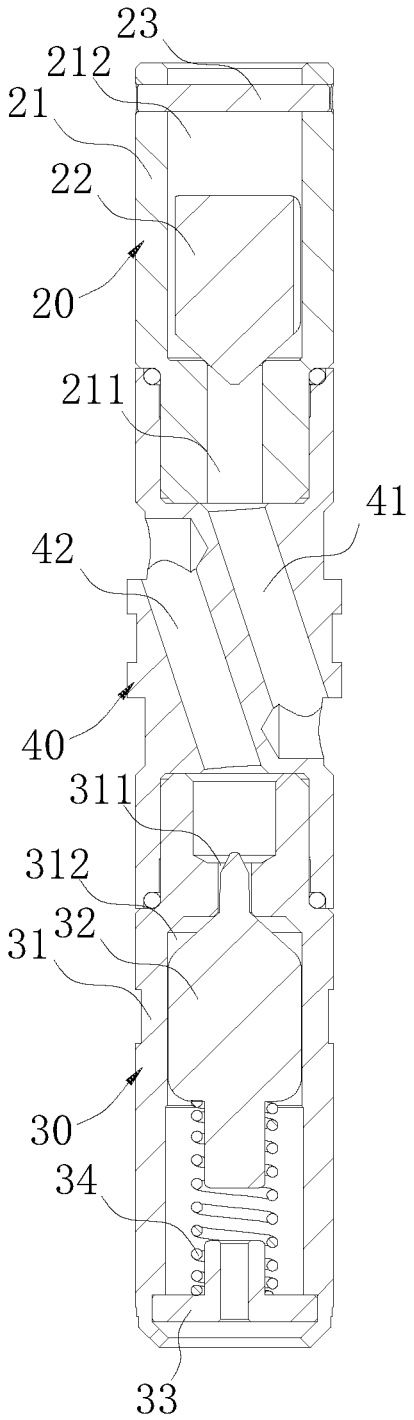
FIG. 3 is an internal schematic view of a valve pipe of a bidirectional throttle valve according to the present disclosure.
Figure 4:
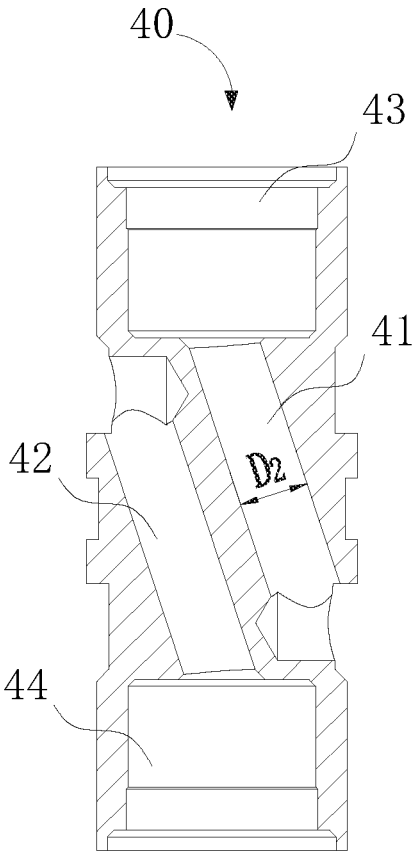
FIG. 4 is a schematic view of a communicating member according to the present disclosure.

Referring to FIG. 3 to FIG. 4, the first channel 41 is a linear channel inclined relative to an axial direction of the communicating member 40. In this way, when the fluid flows in the first channel 41, a flow resistance is small, so that the bidirectional throttle valve 100 has better stability. Accordingly, the second channel 42 is also a linear channel inclined relative to an axial direction of the communicating member 40. Similarly, when the fluid flows in the second channel 42, the flow resistance is smaller, so the stability of the bidirectional throttle valve 100 is better.

In this embodiment, the communicating member 40, the first valve core assembly 20 and the second valve core assembly 30 are coaxially arranged. Coaxial arrangement makes a whole occupied space of the communicating member 40, the first valve core assembly 20 and the second valve core assembly 30 smaller, which is beneficial to a miniaturization design of the valve pipe 10 and greatly reduces an occupied space of the bidirectional throttle valve 100.

Figure 5:
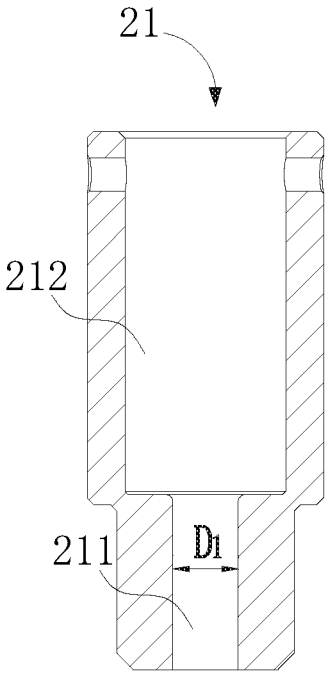
FIG. 5 is a schematic view of a first valve seat according to the present disclosure.

Referring to FIG. 3 to FIG. 5, the first valve core assembly 20 includes a first valve seat 21. The first valve seat 21 is provided with a first seat cavity 212, the first valve core 22 is movably arranged in the first seat cavity 212, and the first valve opening 211 is dispose on the first valve seat 21. An end of the first valve seat 21 away from the second valve core assembly 30 is covered with a first sealing head 23. There is a gap between the first sealing head 23 and the first valve seat 21. The gap is in communication with the first seat cavity 212 and the first valve cavity 11 for fluid to pass through. When the flow area of the first valve opening 211 is reduced to zero, the first valve opening 211 is closed. When the fluid pressure in the first channel 41 is greater than a self-gravity of the first valve core 22, the fluid pushes the first valve core 22 to move to open the first valve opening 211 or increase the flow area of the first valve opening 211, and the fluid flows from the first channel 41 through the first valve opening 211 and the first seat cavity 212 in turn, and finally enters the first valve cavity 11. When the fluid pressure in the first channel 41 is less than a self-gravity of the first valve core 22, the first valve core 22 moves reversely, reducing the flow area of the first valve opening 211, or even closing the first valve opening 211.

Figure 6:
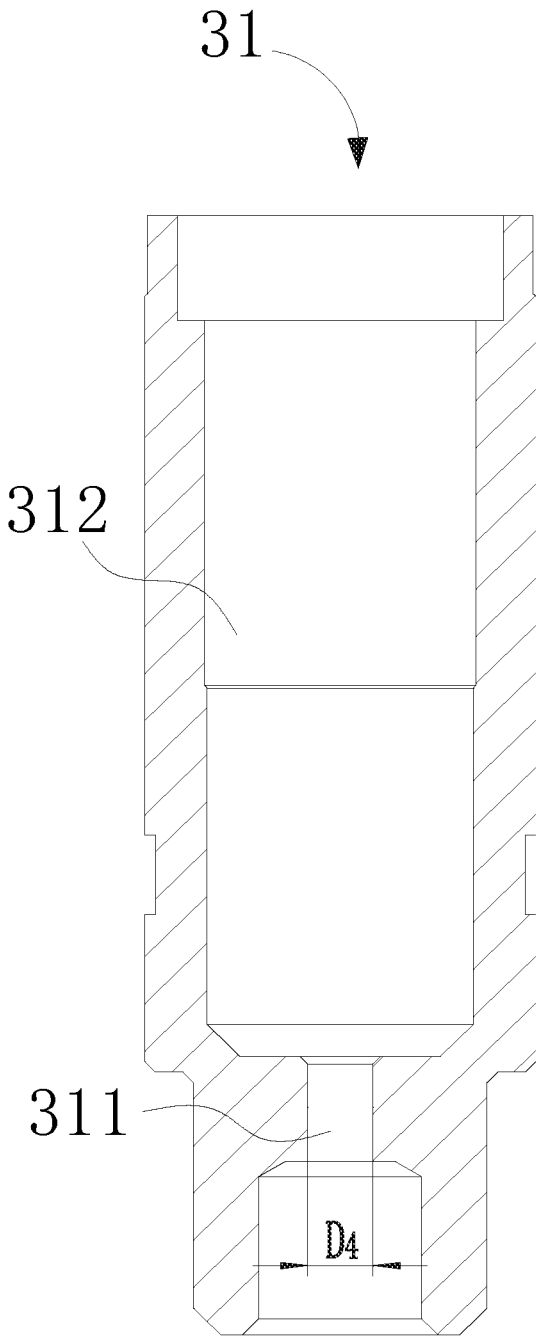
FIG. 6 is a schematic view of a second valve seat according to the present disclosure.

Referring to FIG. 6, the second valve core assembly 30 includes a second valve seat 31. The second valve seat 31 is provided with the second seat cavity 312, the second valve core 32 is movably arranged in the second seat cavity 312, and the second valve opening 311 is disposed on the second valve seat 31. An end of the second valve seat 31 away from the first valve core assembly 20 is covered with a second sealing head 33. There is a gap between the second sealing head 33 and the second valve seat 31. The gap is in communication with the second seat cavity 312 and the second valve cavity 12 for fluid to pass through.

Furthermore, an elastic member 34 is further arranged in the second valve seat 31, and both ends of the elastic member 34 abut against the second valve core 32 and the second sealing head 33, respectively. So that the second valve core 32 tends to reduce the flow area of the second circulation channel. When the flow area of the second valve opening 311 is zero, the second valve opening 311 is in a closed state, and when the flow area of the second valve opening 311 is greater than zero, the second valve opening 311 is in an opened state. Adjusting a size of the flow area of the second valve opening 311 includes both adjusting a size of the flow area in the opened state of the second valve opening 311 and switching the second valve opening 311 between the opened state and the closed state. When the flow area of the second valve opening 311 is reduced to zero, the second valve opening 311 is closed. When a fluid pressure in the second channel 42 is greater than an elastic force of the elastic member 34, the fluid pushes the second valve core 32 to move so as to compress the elastic member 34 and open the second valve opening 311 or increase the flow area of the second valve opening 311, the greater the fluid pressure in the second channel 42, the larger the flow area of the second valve opening 311 is, so that the fluid flows from the second channel 42 through the second valve opening 311 and the second seat cavity 312 in turn, and finally enters the second valve cavity 12. When the fluid pressure in the second channel 42 is less than the elastic force of the elastic member 34, under the elastic restoring force of the elastic member 34, the second valve core 32 moves in an opposite direction and reduces the flow area of the second valve opening 311, even closing the second valve opening 311.

Because the related the bidirectional throttle valve is generally a two-way circulation and two-way throttling structure, the fluid circulation is generally small. For the defrosting condition in the air conditioning system 200, generally, sufficient fluid is needed to defrost the condensed water in the air conditioning system 200. If the bidirectional throttle valve 100 is throttling in both directions, it can not meet the large flow requirements under defrosting conditions.

The bidirectional throttle valve 100 is provided with two valve core assemblies, in which one is set as a full circulation or orifice throttling structure, and the other is set as a throttling structure. It should be noted that the full circulation or orifice throttling structure has a larger flow than the throttling structure. In this way, the bidirectional throttle valve 100 can meet both throttling and large flow under defrosting conditions.

In this embodiment, the first valve core assembly 20 is set as a full circulation or orifice throttling structure. Of course, in other embodiments, the second valve core assembly 30 can also be set as a full circulation or orifice throttling structure, which is not limited here.

When the first valve core assembly 20 is in full circulation state, a size of the first valve opening 211 is defined as D1, a size of the first channel 41 is defined as D2, and a size of the air conditioning system pipeline 90 is defined as D3, and the size D1 of the first valve opening 211, the size D2 of the first channel 41 and the size D3 of the air conditioning system pipeline 90 satisfy the following formula: $D2 \geq D1 \geq D3$. When designing the size of the first valve opening 211 and the size of the first channel 41, the size D1 of the first valve opening 211, the size D2 of the first channel 41 and the size D3 of the air conditioning system pipeline 90 satisfy the following formula: $D2 \geq D1 \geq D3$, so that when the first valve opening 211 is in an opened state, the first valve core assembly 20 will not generate throttling and achieve full circulation.

When the fluid flows into the second valve cavity 12 from the air conditioning system pipeline 90, the fluid flows into the first channel 41 from the gap between the second valve seat 31 and the valve pipe 10. Since the size of the first channel 41 is greater than that of the air conditioning system pipeline 90, the flow channel area becomes greater and full circulation is achieved.

When the first valve core assembly 20 achieves orifice throttling, a size of the first valve opening 211 is defined as D1, and a size of the air conditioning system pipeline 90 is defined as D3, the size D1 of the first valve opening 211 and the size D3 of the air conditioning system pipeline 90 satisfy the following formula: $D1<D3$. When designing the size of the first valve opening 211, the size D1 of the first valve opening 211 and the size D3 of the air conditioning system pipeline 90 satisfy the following formula: $D1<D3$, so that when the first valve opening 211 is opened, the first valve core assembly 20 partially throttles, thus realizing orifice throttling.

When the fluid flows into the second valve cavity 12 from the air conditioning system pipeline 90, the fluid flows into the first valve opening 211 from the gap between the second valve seat 31 and the valve pipe 10. Since the size of the first valve opening 211 is smaller than the size of the air conditioning system pipeline 90, the flow channel area becomes smaller, thus realizing orifice throttling.

Furthermore, in order for the first valve core assembly 20 to better achieve orifice throttling, the size of the second valve opening 311 defined as D4, the size D1 of the first valve opening 211 and the size D4 of the second valve opening satisfy the following formula: $D4>D1>(1/3)D4$. When designing the size of the first valve opening 211 and the second valve opening 311, the size D1 of the first valve opening 211 and the size D4 of the second valve opening satisfy the following formula: $D4>D1>(1/3)D4$, so that when the first valve opening 211 is opened, the orifice throttling can be further achieved at the first valve opening 211.

When the second valve core assembly 30 is set as a throttling structure, the fluid flows into the first valve cavity 11 from the air conditioning system pipeline 90, the fluid flows into the second valve opening 311 from the gap between the first valve seat 21 and the valve pipe 10. Since the size of the second valve opening 311 is also smaller than the size of the air conditioning system pipeline 90, the flow channel area is also reduced at this time, thereby realizing throttling. The circulation of the second valve core assembly 30 is still smaller than that of the first valve core assembly 20 when it is designed as orifice throttling, mainly due to the following structural differences between the first valve core assembly 20 and the second valve core assembly 30.

Figure 7:
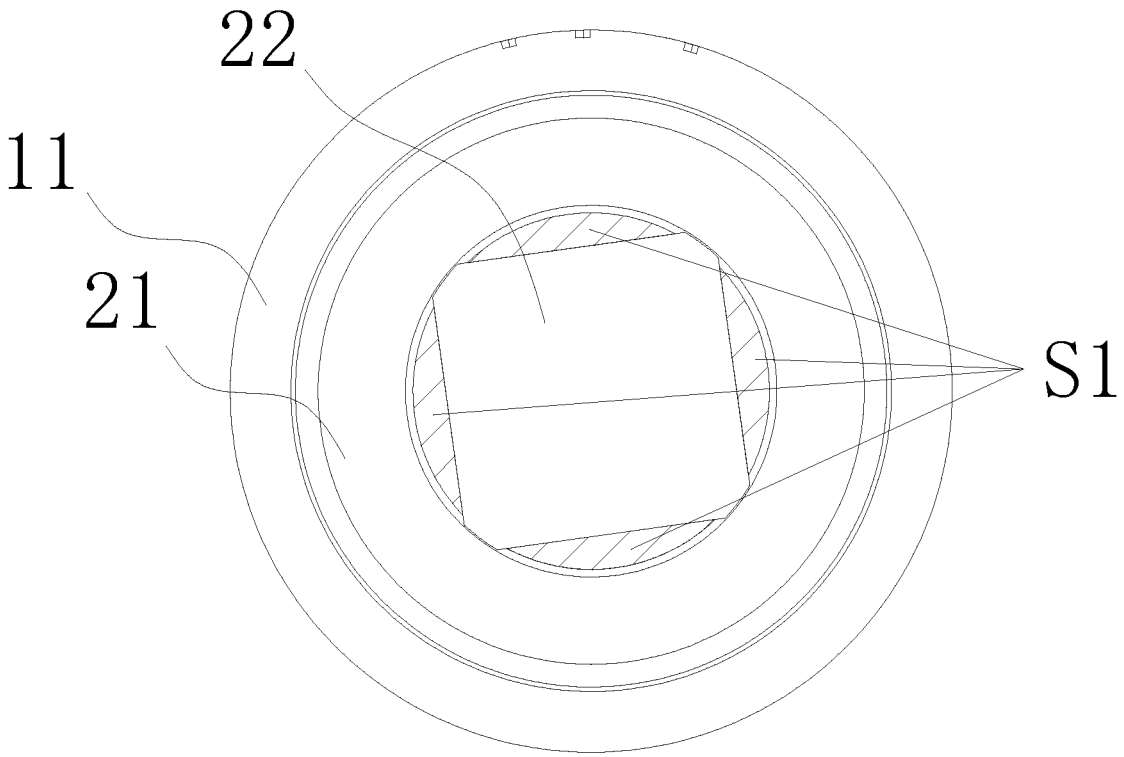
FIG. 7 is a schematic view of a cross-sectional structure at A-A in FIG. 1.
Figure 8:
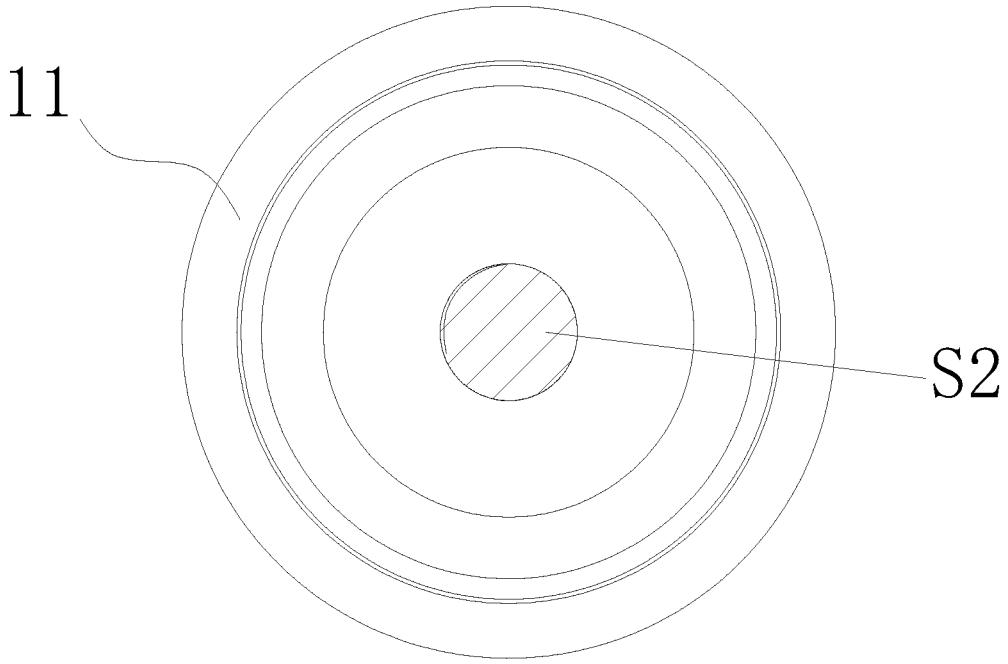
FIG. 8 is a schematic view of a cross-sectional structure at B-B in FIG. 1.
Figure 9:
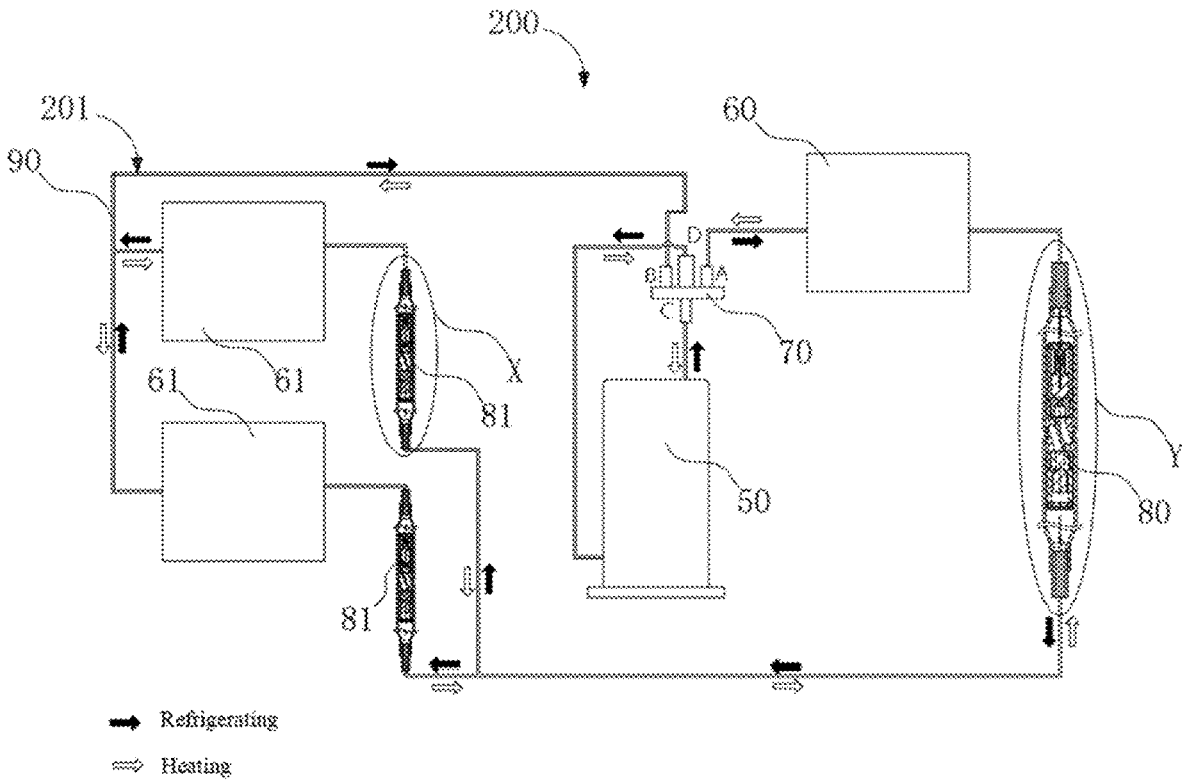
FIG. 9 is a schematic view of a first air conditioning system according to the present disclosure.
Figure 10:
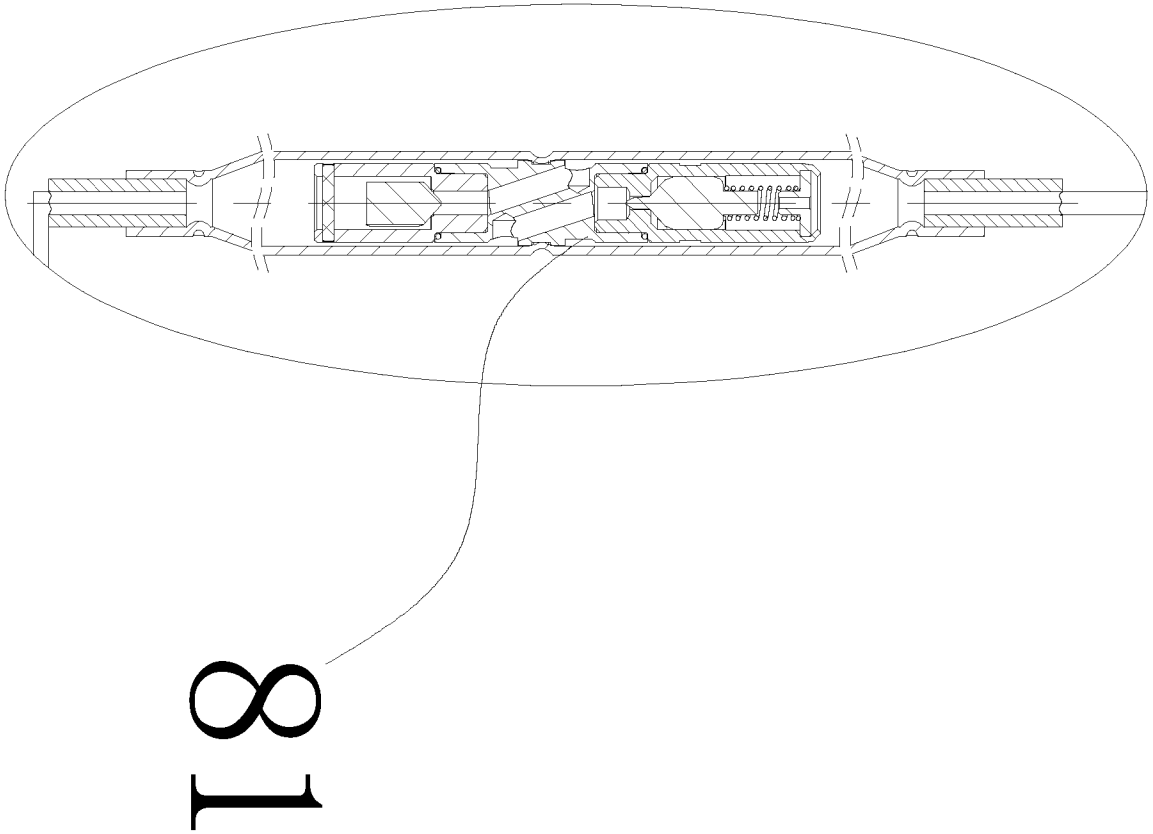
FIG. 10 is a partial enlargement view of portion X in FIG. 9.
Figure 11:
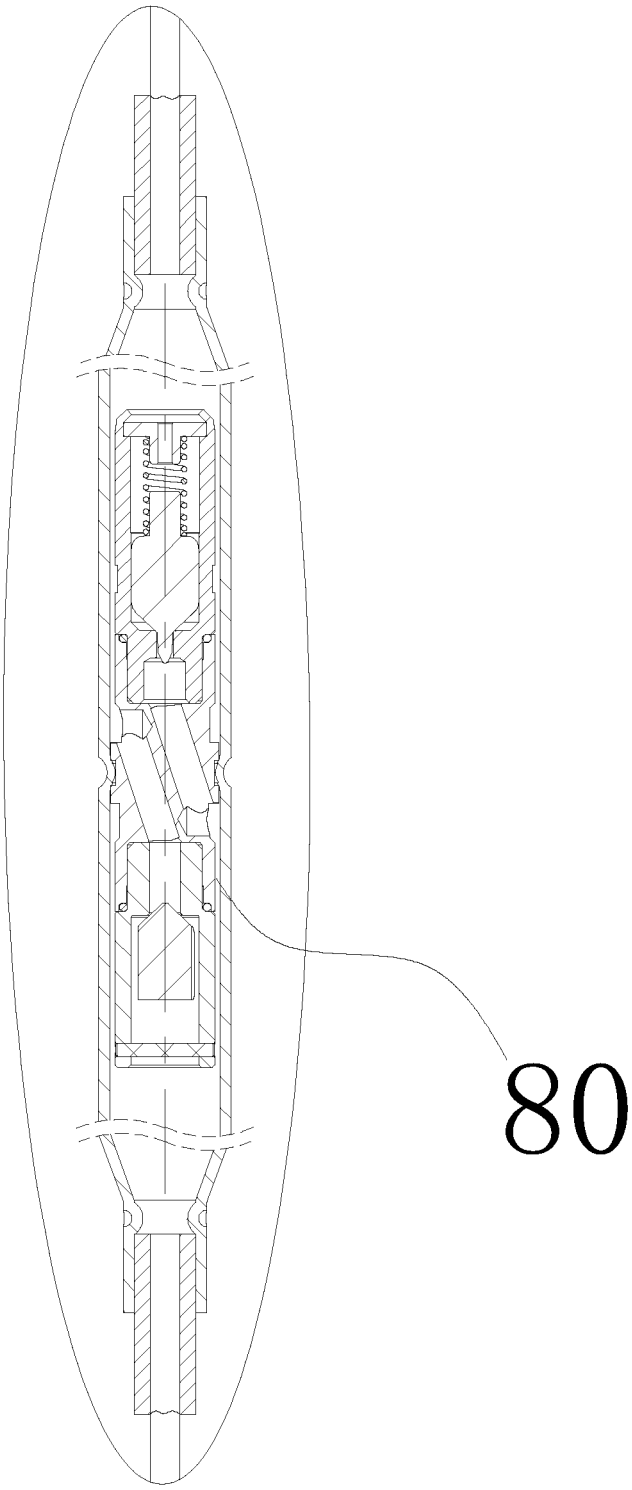
FIG. 11 is a partial enlargement view of portion Y in FIG. 9.

Referring to FIG. 7 to FIG. 8, the first difference is about the difference of flow area. A clearance flow area between the sidewall of the first valve core 22 and the inner wall of the first valve seat 21 is defined as S1, a flow area of the first valve opening 211 is defined as S2. The clearance flow area S1 between the sidewall of the first valve core 22 and the inner wall of the first valve seat 21 is greater than the flow area S2 of the first valve opening 211. A clearance flow area between the sidewall of the second valve core 32 and the inner wall of the second valve seat 31 is smaller than that a flow area of the second valve opening 311. Based on this, due to a pressure difference, a process of opening the first valve core 22 by fluid is obviously easier than that of opening the second valve core 32 by fluid. An opening channel area of the first valve opening 211 is larger than an opening channel area of the second valve opening 311, so the circulation of the first valve core assembly 20 is greater than the circulation of the second valve core assembly 30.

The second difference is about the difference between elastic structures. That is, only the first valve core 22 that can move in the first seat cavity 212 is provided in the first seat cavity 212, in other words, when the fluid pushes the first valve core 22 away from the first valve opening 211, it merely needs to overcome the self-gravity of the first valve core 22, and because the first valve core 22 is not connected with other components, therefore, after the first valve core 22 is pushed open by the fluid, the first valve core 22 will not move in a direction of the first valve opening 211 unless an impact force of the fluid is gradually less than the self-gravity of the first valve core 22, and at this time, the first valve opening 211 has achieved a large flow. In the second seat cavity 312, besides the second valve core 32, there is also the elastic member 34 whose two ends are connected with the second sealing head 33 and the second valve core 32, respectively, that is, when the fluid pushes the second valve core 32 away from the second valve opening 311, it is necessary to overcome the self-gravity of the second valve core 32 and the elastic force of the elastic member 34, and, after the fluid pushes the second valve core 32 to open, the second valve core 32 will move towards the second valve opening 311 due to the elastic restoring force of the elastic member 34, and this trend will also make the circulation at the second valve opening 311 gradually decrease.

To sum up, due to the difference in flow area and elastic structure between the first valve core assembly 20 and the second valve core assembly 30, although the first valve opening 211 is designed as the orifice throttling structure, the circulation at the first valve opening 211 is still greater than the circulation at the second valve opening 311.

In an embodiment, the elastic member 34 is a spring. Of course, in other embodiments, the elastic member 34 can also adopt other elastic structures, which are not limited here.

The present disclosure further provides an conditioning system. In this embodiment, the conditioning system is defined as a first air conditioning system 201. The first air conditioning system includes 201 a compressor 50, a first heat exchanger 60, a second heat exchanger 61, a four-way valve 70 and at least two of the above bidirectional throttle valves 100. The bidirectional throttle valves 100 includes a first bidirectional throttle valve 80 and a second bidirectional throttle valve 81, the first heat exchanger 60 is connected between a first port (A) of the four-way valve 70 and one end of the first bidirectional throttle valve 80 adjacent to the second valve core assembly 30 of the first bidirectional throttle valve 80. The second heat exchanger 61 is connected between a second port (B) of the four-way valve 70 and one end of the second bidirectional throttle valve 81 adjacent to the second valve core assembly 30 of the second bidirectional throttle valve 81, the other end of the first bidirectional throttle valve 80 adjacent to the first valve core assembly 20 of the first bidirectional throttle valve 80 is connected to other end of the second bidirectional throttle valve 81 adjacent to the first valve core assembly 20 of the second bidirectional throttle valve 81. And the compressor 50 is connected between a third port (C) of the four-way valve 70 and a fourth port (D) of the four-way valve 70.

The first air conditioning system 201 is mainly a system with many parts and a length of the air conditioning system pipeline 90 is long. At this time, the bidirectional throttle valve 100 that is suitable for the first air conditioning system 201 is the bidirectional throttle valve 100 with one end for throttling and the other end for fully circulating. When the first air conditioning system 201 is refrigerating, a gas with low temperature and low pressure is compressed by the compressor 50 to form a gas with high temperature and high pressure. And the gas with high temperature and high pressure enters the first heat exchanger 60 through the four-way valve 70 and is condensed by the first heat exchanger 60 into a medium-temperature and high-pressure liquid. The medium-temperature and high-pressure liquid enters the second valve cavity 12 of the first bidirectional throttle valve 80, n flows into the first channel 41 through the gap between the second valve seat 31 and the valve pipe 10, and then enters the first valve opening 211. At this moment, the first valve core 22 is pushed open by the liquid with medium temperature and high pressure, enters the first seat cavity 212 and then enters the first valve cavity 11, because the fluid is fully circulated at the first valve opening 211. Therefore, the liquid with medium temperature and high pressure flowing through the first bidirectional throttle valve 80 is merely equivalent to flowing through the air conditioning system pipeline 90, and has no throttling effect. The liquid with medium temperature and high pressure flows out of the first valve cavity 11 of the first bidirectional throttle valve 80 and then flows into the first valve cavity 11 of the second bidirectional throttle valve 81, flows into the second channel 42 through the gap between the first valve seat 21 and the valve pipe 10, and then flows into the second valve opening 311, after the second valve core 32 is pushed open, it flows into the second seat cavity 312, and finally enters the second valve cavity 12, where the medium-temperature and high-pressure liquid is throttled into low-temperature and low-pressure liquid, then enters the second heat exchanger 61, evaporates through the second heat exchanger 61 to form low-temperature and low-pressure gas, and finally enters the compressor 50 through the four-way valve 70, thus completing a refrigeration cycle.

When the first air conditioning system 201 is heating, a low-temperature and low-pressure gas is compressed by the compressor 50 to form high-temperature and high-pressure gas, and the high-temperature and high-pressure gas enters the second heat exchanger 61 through the four-way valve 70. And heat is released through the second heat exchanger 61 into a medium-temperature and high-pressure liquid, and the medium-temperature and high-pressure liquid enters the second valve cavity 12 of the second directional throttle valve 81. Then it flows into the first channel 41 through the gap between the second valve seat 31 and the valve pipe 10, and then enters the first valve opening 211. At this moment, the first valve core 22 is pushed open by the liquid with medium temperature and high pressure, enters the first seat cavity 212 and then enters the first valve cavity 11, because the fluid is fully circulated at the first valve opening 211, therefore, at this time, the liquid with medium temperature and high pressure flowing through the second bidirectional throttle valve 81 is merely equivalent to flowing through the air conditioning system pipeline 90, which has no throttling effect. The gas with medium temperature and high pressure flows out of the first valve cavity 11 of the second directional throttle valve 81 and then flows into the first valve cavity 11 of the first directional throttle valve 80, flows into the second channel 42 through the gap between the first valve seat 21 and the valve pipe 10, and then flows into the second valve opening 311. After the second valve core 32 is pushed open, it flows into the second seat cavity 312 and finally into the second valve cavity 12. The medium temperature and high pressure liquid is throttled into low temperature and low pressure liquid or gas-liquid two-phase medium, then enters the first heat exchanger 60, evaporates through the first heat exchanger 60 to form low-temperature and low-pressure gas, and finally enters the compressor 50 through the four-way valve 70, thus completing a heating cycle.

The second heat exchanger 61 and the second bidirectional throttle valve 81 can be connected in parallel, and the specific number depends on the specific situation of the air conditioning system 200. That is, the first air conditioning system 201 includes at least two of the second heat exchangers 61 and at least two of the second bidirectional throttle valves 81. Each of the at least two second heat exchangers 61 is connected between a second port (B) of the four-way valve 70 and one end of each of the at least two second bidirectional throttle valves 81 adjacent to the second valve core assembly 30 of the second bidirectional throttle valve 81, the other end of each of the at least two second bidirectional throttle valves 81 adjacent to the first valve core assembly 20 of the second bidirectional throttle valve 81 is connected to each other.

The bidirectional throttle valve 100 in which the first valve core assembly 20 is in full circulation and the second valve core assembly 30 is in throttle flow is mainly used in the first air conditioning system 201. The problem is solved when the air conditioning system pipeline 90 is long, the refrigeration and heat cycle shares one the bidirectional throttle valve 100 and the cooling loss is greater.

Figure 12:
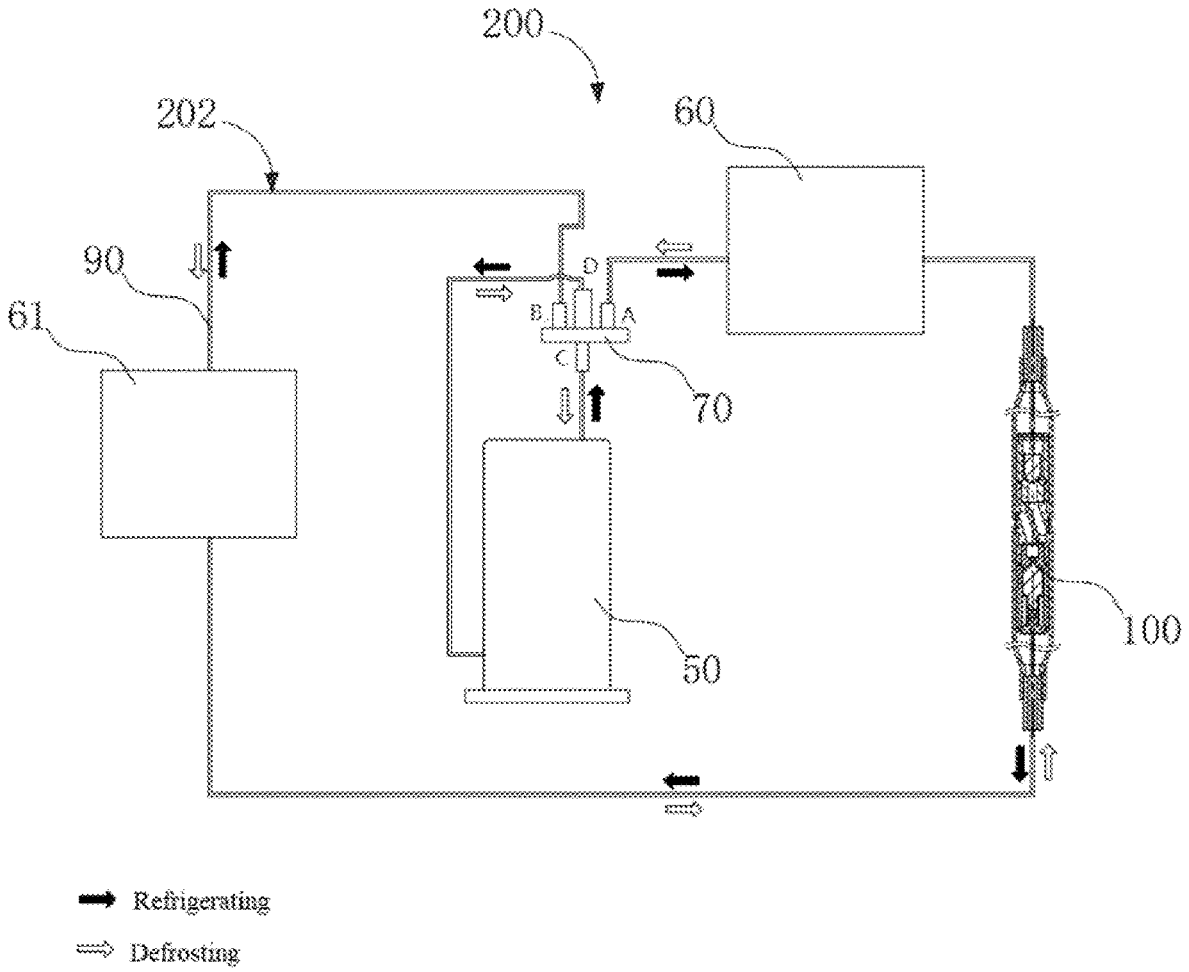
FIG. 12 is a schematic view of a second air conditioning system according to the present disclosure.

Referring to FIG. 12, the present disclosure further provides an conditioning system. In this embodiment, the conditioning system is defined as a second air conditioning system 201. The second air conditioning system 202 includes a compressor 50, a first heat exchanger 60, a second heat exchanger 61, a four-way valve 70 and one of the above bidirectional throttle valve 100. The first heat exchanger 60 is connected between a first port (A) of the four-way valve 70 and one end of the bidirectional throttle valve 100 adjacent to the first valve core assembly 20 of the bidirectional throttle valve 100. The second heat exchanger 61 is connected between a second port (B) of the four-way valve 70 and one end of the bidirectional throttle valve 100 adjacent to the second valve core assembly 30 of the bidirectional throttle valve 100. And the compressor 50 is connected between a third port (C) of the four-way valve 70 and a fourth port (D) of the four-way valve 70.

The second air conditioning system 202 is mainly a system with fewer parts and shorter the air conditioning system pipeline 90. At this time, the bidirectional throttle valve 100 which is suitable for the second air conditioning system 202 is the bidirectional throttle valve 100 with one end for throttling and the other end for small-hole circulating. When the second air conditioning system 202 is refrigerating, a gas with low temperature and low pressure is compressed by the compressor 50 to form high-temperature and high-pressure gas. The high-temperature and high-pressure gas enters the first heat exchanger 60 through the four-way valve 70and is condensed by the first heat exchanger 60 into a medium-temperature and high-pressure liquid. The medium-temperature and high-pressure liquid enters the first valve cavity 11 of the bidirectional throttle valve 100. Then, it flows into the second channel 42 through a gap between the first valve seat 21 and the valve pipe 10 and further enters the second valve opening 311, at which time the second valve core 32 is pushed open by the liquid with medium temperature and high pressure, enters into the second seat cavity 312, and then enters into the second valve cavity 12. Because the fluid is throttled at the second valve opening 311, the medium-temperature and high-pressure liquid flows through the bidirectional throttle valve 100 and is throttled into a low-temperature and low-pressure liquid or a low-temperature and low-pressure gas-liquid medium with two-phase state. Then it flows out of the second valve cavity 12 of the bidirectional throttle valve 100, flows into the second heat exchanger 61, evaporates through the second heat exchanger 61 to form low-temperature and low-pressure steam, and finally enters the compressor 50 through the four-way valve 70, thus completing a refrigeration cycle.

When the second air conditioning system 202 is defrosting, the low-temperature and low-pressure gas is compressed by the compressor 50 to form high-temperature and high-pressure gas, and the high-temperature and high-pressure gas enters the second heat exchanger 61 through the four-way valve 70 and is condensed into medium-temperature and high-pressure liquid through the second heat exchanger 61. The medium-temperature and high-pressure liquid enters the second valve cavity 12 of the bidirectional throttle valve 100. Then it flows into the first channel 41 through the gap between the second valve seat 31 and the valve pipe 10 and then enters the first valve opening 211. The first valve core 22 is pushed open by a liquid with medium temperature and high pressure. The liquid with medium temperature and high pressure enters the first seat cavity 212 and then the first valve cavity 11. Because the fluid is throttled into a low-temperature and low-pressure liquid or gas-liquid two-phase medium at the first valve opening 211, the flow area increases at this time and the fluid volume increases accordingly. Low temperature and low pressure liquid or gas-liquid two-phase medium flows out of the first valve cavity 11 of the bidirectional throttle valve 100 and then flows into the first heat exchanger 60. Vaporized by the first heat exchanger 60, low-temperature and low-pressure gas is formed, and finally enters the compressor 50 through the four-way valve 70, thus completing a defrosting cycle.

The bidirectional throttle valve 100 whose the first valve core assembly 20 is in orifice throttling and the second valve core assembly 30 is in throttle flow is mainly used in the second bidirectional throttle valve 202, which is mainly used in refrigeration and freezing occasions to solve the problem that the refrigerant flow needs to be greatly increased when the air conditioning system 200 is defrosted in a long-term refrigeration environment.

It should be explained that the above air conditioning system 200 can be either the first air conditioning system 201 or the second air conditioning system 202.

The bidirectional throttle valve 100 provided by the present disclosure, when the first valve opening 211 and the second valve opening 311 are both in an opened state, the present disclosure can enlarge the flow area of the first circulation channel compared to the flow area of the second circulation channel. This approach not only enables the bidirectional throttle valve 100 to achieve both bidirectional circulation and unidirectional throttling functions, but also meets requirements of low pressure and high flow rates under the defrosting condition.

One of ordinary skill in the art should recognize that the above embodiments are used only to illustrate the present disclosure and are not used to limit the present disclosure, and that appropriate variations and improvements to the above embodiments fall within the protection scope of the present disclosure so long as they are made without departing from the substantial spirit of the present disclosure.

What is claimed is:

1. A bidirectional throttle valve, comprising a valve pipe, wherein a first valve core assembly and a second valve core assembly are arranged at two ends in the valve pipe, respectively, the first valve core assembly comprises a first valve core, a first valve opening is arranged in the first valve core assembly, the first valve core is movably arranged in the valve pipe and capable of opening or closing the first valve opening, and the first valve core cooperates with an inner wall of the first valve opening to form a first circulation channel;

the second valve core assembly comprises a second valve core, a second valve opening is arranged in the second valve core assembly, the second valve core is movably arranged in the valve pipe and capable of opening or closing the second valve opening, and the second valve core cooperates with an inner wall of the second valve opening to form a second circulation channel;

wherein when the first valve opening and the second valve opening are in an opened state, a flow area of the first circulation channel is greater than a flow area of the second circulation channel, and the second valve core cooperates with the second valve opening to achieve throttling;

the valve pipe is connected to an air conditioning system pipeline, a communicating member is further arranged in the valve pipe, and the first valve core assembly is installed at an end of the communicating member;

the communicating member is provided with a first channel, which is connected with and in communication with the first valve opening;

a size of the first valve opening is define as D1, a size of the first channel is define as D2, and a size of the air conditioning system pipeline is define as D3, and the size D1 of the first valve opening, the size D2 of the first channel and the size D3 of the air conditioning system pipeline satisfy the following formula: $D2 \geq D1 \geq D3$.

2. The bidirectional throttle valve of claim 1, wherein the first valve core assembly comprises a first valve seat, the first valve core is movably arranged in the first valve seat, and the first valve opening is disposed on the first valve seat;

a flow area of a gap between a sidewall of the first valve core and an inner wall of the first valve seat is greater than a flow area of the first valve opening.

3. The bidirectional throttle valve of claim 1, wherein the second valve core assembly comprises a second valve seat, the second valve core is movably arranged in the second valve seat, and the second valve opening is disposed on the second valve seat;

a flow area of a gap between a sidewall of the second valve core and an inner wall of the second valve seat is smaller than a flow area of the second valve opening.

4. The bidirectional throttle valve of claim 1, wherein the first valve core assembly comprises a first valve seat, and the first valve core is movably arranged in the first valve seat;

an end of the first valve seat away from the second valve core assembly is provided with a first sealing head.

5. The bidirectional throttle valve of claim 1, wherein the second valve core assembly comprises a second valve seat, and the second valve core is movably arranged in the second valve seat;

a second sealing head and an elastic member are arranged in the second valve seat, the second sealing head is arranged at an end of the second valve seat away from the first valve core assembly, and two ends of the elastic member abut against the second valve core and the second sealing head, respectively.

6. The bidirectional throttle valve of claim 1, wherein the first channel is a linear channel inclined relative to an axial direction of the communicating member.

7. The bidirectional throttle valve of claim 1, disposed within a first air conditioning system, the air conditioning system comprising a compressor, a first heat exchanger, a second heat exchanger, a four-way valve and at least two of the bidirectional throttle valves, the bidirectional throttle valves comprises a first bidirectional throttle valve and a second bidirectional throttle valve, the first heat exchanger is connected between a first port (A) of the four-way valve and one end of the first bidirectional throttle valve adjacent to the second valve core assembly; the second heat exchanger is connected between a second port (B) of the four-way valve and one end of the second bidirectional throttle valve adjacent to the second valve core assembly; the other end of the first bidirectional throttle valve adjacent to the first valve core assembly is connected to other end of the second bidirectional throttle valve adjacent to the first valve core assembly; and the compressor is connected between a third port (C) of the four-way valve and a fourth port (D) of the four-way valve.

8. The first air conditioning system of claim 7, wherein the number of the second heat exchanger is at least two, and the number of the second bidirectional throttle valve is at least two; each of the at least two second heat exchangers is connected between a second port (B) of the four-way valve and one end of each of the at least two second bidirectional throttle valves adjacent to the second valve core assembly, the other end of each of the at least two second bidirectional throttle valves adjacent to the first valve core assembly are connected with each other.

9. The first air conditioning system of claim 7, wherein the first valve core assembly comprises a first valve seat, the first valve core is movably arranged in the first valve seat, and the first valve opening is disposed on the first valve seat;

a flow area of a gap between a sidewall of the first valve core and an inner wall of the first valve seat is greater than a flow area of the first valve opening.

10. The first air conditioning system of claim 7, wherein the second valve core assembly comprises a second valve seat, the second valve core is movably arranged in the second valve seat, and the second valve opening is disposed on the second valve seat;

a flow area of a gap between a sidewall of the second valve core and an inner wall of the second valve seat is smaller than a flow area of the second valve opening.

11. The first air conditioning system of claim 7, wherein the first channel is a linear channel inclined relative to an axial direction of the communicating member.

12. A bidirectional throttle valve, comprising a valve pipe, wherein a first valve core assembly and a second valve core assembly are arranged at two ends in the valve pipe, respectively, the first valve core assembly comprises a first valve core, a first valve opening is arranged in the first valve core assembly, the first valve core is movably arranged in the valve pipe and capable of opening or closing the first valve opening, and the first valve core cooperates with an inner wall of the first valve opening to form a first circulation channel;

the second valve core assembly comprises a second valve core, a second valve opening is arranged in the second valve core assembly, the second valve core is movably arranged in the valve pipe and capable of opening or closing the second valve opening, and the second valve core cooperates with an inner wall of the second valve opening to form a second circulation channel;

wherein when the first valve opening and the second valve opening are in an opened state, a flow area of the first circulation channel is greater than a flow area of the second circulation channel, and the second valve core cooperates with the second valve opening to achieve throttling;

the valve pipe is connected to an air conditioning system pipeline, a communicating member is further arranged in the valve pipe, and the first valve core assembly is installed at an end of the communicating member;

a size of the first valve opening is define as D1, and a size of the air conditioning system pipeline is define as D3, the size D1 of the first valve opening and the size D3 of the air conditioning system pipeline satisfy the following formula: $D1<D3$.

13. The bidirectional throttle valve of claim 12, wherein a size of the second valve opening is define as D4, the size D1 of the first valve opening and the size D4 of the second valve opening satisfy the following formula: $D4>D1>(1/3)D4$.

14. The bidirectional throttle valve of claim 12, wherein the first valve core assembly comprises a first valve seat, the first valve core is movably arranged in the first valve seat, and the first valve opening is disposed on the first valve seat;

a flow area of a gap between a sidewall of the first valve core and an inner wall of the first valve seat is greater than a flow area of the first valve opening.

15. The bidirectional throttle valve of claim 12, wherein the second valve core assembly comprises a second valve seat, the second valve core is movably arranged in the second valve seat, and the second valve opening is disposed on the second valve seat;

a flow area of a gap between a sidewall of the second valve core and an inner wall of the second valve seat is smaller than a flow area of the second valve opening.

16. The bidirectional throttle valve of claim 12, wherein the first valve core assembly comprises a first valve seat, and the first valve core is movably arranged in the first valve seat;

an end of the first valve seat away from the second valve core assembly is provided with a first sealing head.

17. The bidirectional throttle valve of claim 12, wherein the second valve core assembly comprises a second valve seat, and the second valve core is movably arranged in the second valve seat;

a second sealing head and an elastic member are arranged in the second valve seat, the second sealing head is arranged at an end of the second valve seat away from the first valve core assembly, and two ends of the elastic member abut against the second valve core and the second sealing head, respectively.

18. The bidirectional throttle valve of claim 12, wherein the first channel is a linear channel inclined relative to an axial direction of the communicating member.

19. The bidirectional throttle valve of claim 12, disposed within a second air conditioning system, the air conditioning system comprising a compressor, a first heat exchanger, a second heat exchanger, a four-way valve and at least one of the bidirectional throttle valve, the first heat exchanger is connected between a first port (A) of the four-way valve and one end of the bidirectional throttle valve adjacent to the first valve core assembly; the second heat exchanger is connected between a second port (B) of the four-way valve and one end of the bidirectional throttle valve adjacent to the second valve core assembly; and the compressor is connected between a third port (C) of the four-way valve and a fourth port (D) of the four-way valve.

20. The second air conditioning system of claim 19, wherein a size of the second valve opening is define as D4, the size D1 of the first valve opening and the size D4 of the second valve opening satisfy the following formula: $D4>D1>(1/3)D4$.

* * * * *